United States Patent [19]

Beane et al.

[11] Patent Number: 5,051,283

[45] Date of Patent: Sep. 24, 1991

[54] PROCESS FOR ENVIRONMENTALLY SOUND WOOD FINISHING

[75] Inventors: Bobby E. Beane, Sophia; Eugen Safta, Winston Salem, both of N.C.

[73] Assignee: Lilly Industrial Coatings, Inc., Indianapolis, Ind.

[21] Appl. No.: 654,259

[22] Filed: Feb. 12, 1991

[51] Int. Cl.[5] ..... B05D 7/06

[52] U.S. Cl. ..... 427/440; 427/325; 427/393; 427/393.4; 427/397; 427/408; 427/419.8

[58] Field of Search ..... 427/393, 393.4, 397, 427/408, 419.1, 419.8, 440, 325; 8/181, 196, 402; 428/537.1, 541

[56] References Cited

U.S. PATENT DOCUMENTS

| | | | |
|---|---|---|---|
| 3,494,878 | 2/1970 | Harren et al. | 526/93 |
| 3,900,620 | 8/1975 | Gilman et al. | 427/325 |
| 4,075,394 | 2/1978 | Meyer | 428/537 |
| 4,104,228 | 8/1978 | Meyer et al. | 427/408 |
| 4,410,652 | 10/1983 | Robinson et al. | 524/195 |
| 4,732,817 | 3/1988 | Lotz et al. | 106/18.35 |
| 4,764,585 | 8/1988 | Heller et al. | 528/233 |
| 4,767,421 | 8/1988 | van der Veen et al. | 8/523 |

FOREIGN PATENT DOCUMENTS

| | | | |
|---|---|---|---|
| WO82/04008 | 11/1982 | PCT Int'l Appl. | 427/325 |
| 21212175 | 7/1989 | United Kingdom . | |

OTHER PUBLICATIONS

"Update", Home, Oct. 1990, pp. 28-30, Janice M. Nagano.

Abstract, "Anticorrosive Coatings With Cation- And Anion-Exchange Resins", Karol Barton et al. (1960).

Abstract, "Electrochemical Membrane Properties of Anticorrosive-Coating Films", H. Brandt (1964).

"Dyeing and Chemical Technology of Textile Fibres", E. R. Trotman, Charles Griffen & Company Ltd., ed., Sixth Edition, pp. 166-167 (1984).

Technical Data Sheet for Versamine ®A50, Henkel Polymers Division, LaGrange, Ill. (not dated).

Product Information Sheet for Sandofix ® TP Liguid, Sandoz Chemicals (not dated).

Product Information Sheet for Sandofix ® SWE Liquid, Sandoz Chemicals (not dated).

*Primary Examiner*—Shrive Beck

*Assistant Examiner*—Terry J. Owens

*Attorney, Agent, or Firm*—Barnes & Thornburg

[57] ABSTRACT

Discoloration of water-based coatings due to uneven leaching of chromophoric substances, such as natural tannins and applied stains, is eliminated by contacting the surface with a water soluble anti-leachate compound selected from the group consisting of carboxylic acid salts, mono/polyfunctional amines and amine derivatives and their acid addition salts.

31 Claims, No Drawings

PROCESS FOR ENVIRONMENTALLY SOUND WOOD FINISHING

FIELD OF INVENTION

This invention relates to wood finishing processes. More particularly, this invention is directed to a method for improving the quality of water-based coatings applied to surfaces having leachable chromophoric substances. The invention allows for the environmentally responsible substitution of water-based coatings for the traditional solvent-based coatings in commercial wood finishing operations.

BACKGROUND AND SUMMARY OF THE INVENTION

The patent and technical literature reflects significant on-going research and development effort targeting the advancement of coatings technology for use in industrial and architectural applications. Much research focus has been toward the development of water-based emulsion coatings as replacements for the traditional solvent-based coating formulations. Although water-based coatings suffer some disadvantages (they freeze in cold weather, corrode containers, support bacterial growth), their advantages, including reduced toxicity and reduced flammability and better adherence to damp substrates have encouraged their use for many high grade industrial and architectural finishes. Indeed, some of today's modern water-based emulsion type coating formulations can produce films having performance characteristics unmatched by that available through traditional solvent-based coating applications.

Notwithstanding the rapid evolution of water-based coating technology over the last two decades, such coatings have found little acceptance and use in the wood finishing industry. That is due in part to the fact that much effort has gone into developing present finishing schedules utilizing, for the most part, solvent-based coatings. Wood finishing production managers are hesitant to change existing processes which have not only proven to provide consistent product quality but have been developed to do so with optimum cost efficiency. Moreover, the use of water-borne coatings in the wood finishing industry is known by those skilled in this art to have at least one added disadvantage unique for wood finishing applications—water soluble chromophoric (colored) compounds on and in the wood surface bleed through the applied water-based coatings to stain or otherwise blemish the resulting finish. The bleeding of natural occurring tannins, for example, result in staining of applied water-based emulsion paints. Such tannin leachates can also be seen in non-uniformity of color and turbidity in stain-based finishing schedules utilizing water-based finishes. Indeed, it is well-known that the applied stains themselves leach with the natural occurring tannins through after-applied water-based finishes to further distract from finish quality obtainable with water-based coatings.

Yet, in spite of all of the problems presented by use of water-based coatings in the wood finishing industry, proposed state and federal legislation, and promulgation of air quality rules by state and federal agencies may require the wood finishing industry to look to the water-based coating alternatives as a means for reducing its use and release of volatile organic compounds (VOCs).

It is one object of this invention to provide an environmentally sound water-based wood finishing process for obtaining high quality finishes on wood surfaces by eliminating leaching of chromophoric compounds into applied water-based coatings.

It is another object of this invention to provide an improved wood finishing process comprising application of a stain to a wood substrate and subsequent application of at least one water-based coating composition.

In a further embodiment this invention provides a method for reducing volatile organic compounds released in wood finishing processes without sacrificing wood finish quality.

In still another aspect of this invention there is provided a method for preventing discoloration of water-based coatings applied to substrate surfaces due to leaching of chromophoric compounds from the surface into the applied coating.

In one other embodiment there is provided a water-based coating composition comprising anti-leaching effective amounts of a carboxylic acid salt and a water soluble organic compound bearing one or more salt-forming amine groups.

Those and other embodiments of this invention are accomplished by applying to a surface having leachable chromophoric components an effective amount of a carboxylic acid salt and/or a water soluble organic compound bearing one or more salt-forming amine groups and having a molecular weight of about 50 to about 300,000. The amine compound is preferably a monofunctional or polyfunctional amine, or a reaction product of a monofunctional or polyfunctional amine with one or more compounds comprising an amine-reactive functional group, said reaction product having at least one salt forming primary, secondary or tertiary amine group, or acid addition salts of such monofunctional or polyfunctional amines and their said reaction products. The compounds are preferably applied to substrate surfaces in aqueous solution prior to application of the water-based coating. Alternatively the carboxylic acid salt and/or amine compound can be included as a functional component of the water-based coating. Use of the present invention allows reduction, indeed, virtual elimination of usage of volatile organic compounds in commercial wood finishing operations. Water-based coatings can be substituted for traditional solvent-based coatings without loss of the coating quality characteristics of such traditional solvent-based coatings, and with little, if any, added processing costs/-time compared to traditional finishing schedules.

DETAILED DESCRIPTION OF THE INVENTION

The present invention is based on our discovery that wood and other surfaces having leachable chromophoric substances can be treated with readily available carboxylic acid salts or amine compounds to sequester and Prevent leaching of chromophoric substances, particularly naturally occurring tannins in wood surfaces, into after-applied water-based coatings. Thus, for example, a water-based acrylic enamel can be applied directly to a wood surface treated in accordance with this invention without discoloration of the applied coating due to leaching of chromophoric tannins from the wood surface into the applied enamel coating. Further, stained wood surfaces can be finished substantially in accordance with standard finishing schedules, but with substitution of water-based finishing formulations, e.g., wash coats, sanding sealers, wash coat toners, glazing sealers, shade stains, and aqueous top coat formulations. Treatment of stained surfaces with a tannin-sequestering composition in accordance with this invention enables the environmentally significant substitution of water-based coatings for solvent-based coatings in commercial wood finishing operations without sacrificing coating quality. Surface treatment in accordance with this invention inhibits leaching of chromophoric compounds including tannins, surface applied stains, rust (for example, from nail heads at the surface) and other leachable chromophoric compounds in man-made substrates (e.g., wall-board, composition board, gypsum board and the like) into the after-applied water-based coatings. The substitution of water-based coatings for the traditional solvent-based coatings used in the wood finishing industry enabled in accordance with the present invention allows its users to enjoy a significant reduction in VOC usage/emission in their wood finishing operations. Such facilitates compliance with state and federal air quality standards and concomitantly allows a safer working environment for company employees.

Tannin sequestering agents identified for use in accordance with the present invention include carboxylic acid salts and water soluble organic compounds bearing one or more salt-forming amine groups and having a molecular weight of about 50 to about 300,000.

Carboxylic acid salts for use in accordance with this invention include the water soluble salts of $C_1$–$C_{18}$ mono and dibasic carboxylic acids. Exemplary of carboxylic acid salts for use in accordance with this invention are the alkali metal salts, more preferably sodium and potassium salts of acetic acid, propionic acid, butyric acid, hexanoic acid, octanoic acid, dodecanoic acid, palmitic acid, myristic acid, stearic acid, oxyalic acid, maleic acid, succinic acid, 3,4-hexanedioic acid, and the like. Preferred carboxylic salts in accordance with this invention are the alkali metal salts, more preferably sodium and potassium salts of $C_1$–$C_6$ carboxylic acids.

The salt-forming organic amine compounds useful in accordance with this invention preferably have a molecular weight between about 150 and about 100,000, more preferably about 500 to about 50,000. Such compounds include monofunctional or polyfunctional amines, reaction products of monofunctional/polyfunctional amines with one or more compounds comprising an amine reactive functional group, said reaction products having at least one salt-forming primary, secondary or tertiary amine group, or acid addition salts of said monofunctional or polyfunctional amines and their said reaction products.

Preferred monofunctional amines are $C_1$–$C_8$ alkyl or $C_1$–$C_8$ alkenyl amines, more preferably $C_1$–$C_4$ alkyl amines. Polyfunctional amines have two or more amine groups, including primary and/or secondary and/or tertiary amine groups. Preferred polyfunctional amines are $C_2$–$C_5$ alkenylenediamenes or poly-$C_2$–$C_4$ alkylene polyamines having 3 to 6 nitrogen atoms. Most preferred polyfunctional amines are ethylene diamine, diethylamine triamine, and triethylene tetraamine. Another preferred group of amine compounds useful in accordance with this invention are the reaction products of monofunctional or Polyfunctional amines with one or more compounds comprising an amine reactive functional group. Compounds comprising amine reactive functional groups include cyanamide, dicyanamide, guanidine, bisguanidine, formaldehyde, acetaldehyde, a dicarboxylic acid, a dicarboxylic acid monoester, a dicarboxylic acid diester, epichlorohydrin, and an N-methylol derivative of urea, melamine, guanamine, or a carbamate. Such compounds are well known in the art and are described more particularly in U.S. Pat. No. 4,764,585, and U.S. Pat. No. 4,410,652, expressly incorporated herein by reference.

One preferred group of tannin-complexing compounds for use in accordance with this invention is the product of reacting a $C_2$–$C_5$ alkylene diamine or a poly-$C_2$–$C_4$ alkylene polyamine having 3–6 nitrogen atoms with cyanamide, dicyanamide, guanidine or bisguanidine, and the reaction products of such compounds with epichlorohydrin or a compound selected from N,N'-dimethylol-4,5-dihydroxyethylene urea, N,N'-dimethylol-4,5-dimethoxyethylene urea, and N,N'-dimethylol carbamate or a $C_1$–$C_4$ alkyl ether thereof.

Many of the aforementioned organic monofunctional or polyfunctional amine compounds are commercially available but detailed for other uses. Thus, for example, Versamine® A-50 sold by Henkle Polymers Division is a diethylene triamine adduct developed especially for use in liquid epoxy resins. Other commercially available polyfunctional amine products include textile dye fixatives, for example, polyfunction amine compounds sold under the Sandofix® trademark by Sandoz Chemical, Inc., of Charlotte, N.C. Surprisingly, it appears that many compounds useful as dye fixatives in the textile industry are effective for sequestering tannins in wood substrates to prevent the bleeding of such natural chromophoric substances into after-applied water-based coatings.

The tannin-sequestering compounds useful in accordance with this invention are preferably applied to wood surfaces either as a component of an aqueous emulsion intended for application to a wood surface as a primer, wash coat or sealer or more preferably, as a non-resinous aqueous solution or wash coat. The tannin sequestering agents can be used alone or in combination, preferably in aqueous solution, typically forming about 2 to about 50% by weight of the aqueous composition. Particularly good results have been achieved utilizing tannin-sequestering compositions comprising about 1 to about 25% by weight of a carboxylic acid salt and about 1 to about 50% by weight of a mono or polyfunctional amine or amine derivative, as set forth above, and about 25% to about 98% by weight water.

The tannin-sequestering compositions can be applied to substrate surfaces in accordance with this invention by brushing, dipping, spraying, pouring, curtain coating or any other art-recognized means of application. Wood surfaces being prepared for subsequent application of aqueous acrylic emulsions or urethane dispersions are typically prepared by dipping or spraying an aqueous solution of one or more tannin-sequestering agents either as a non-resinous aqueous solution or as a low-solids acrylic emulsion wash coat. The water-based coating can then be applied to the surface following an optional light sanding of the surface. Where the wood finishing process includes application of a wood stain, the sequestering agents can be applied before or after stain application. However, it is preferred that the tannin-sequestering solution be applied either as a non-resinous aqueous solution or as a lightly resinous wash coat after stain application and before sanding, filling, sealing and application of the water-based top coats.

The water-based emulsion coatings usable in accordance with the present invention as a substitute for traditional solvent-based coatings typically comprise a dispersed vinyl addition-type polymer, including homopolymers and copolymers of (1) vinyl esters of an aliphatic acid having 1 to 18 carbon atoms, especially vinyl acetate; (2) acrylic acid esters and methacrylic acid esters of an alcohol having 1 to 18 carbon atoms, especially methylacrylate, ethylacrylate, butylacrylate, 2-ethylhexylacrylate, methyl methacrylate, ethyl methacrylate, butyl methacrylate; and (3) mono- and diethylenically unsaturated hydrocarbons, such as ethylene, isobutylene, styrene, and aliphatic dienes such as butadiene, isoprene and chloroprene.

Poly(vinyl acetate) and copolymers of vinyl acetate with one or more of the following monomers: vinyl chloride, vinylidene chloride, styrene, vinyl toluene, acrylonitrile, methacrylonitrile, one or two of the acrylic and methacrylic acid esters mentioned above, are well known as film-forming components of water-based paints. Similarly copolymers of one or more of the acrylic or methacrylic esters mentioned above with one or more of the following monomers: vinyl acetate, vinyl chloride, vinylidene chloride, styrene, vinyl toluene, acrylonitrile and methacrylonitrile are conventionally employed in aqueous based paints. It is common to include a small amount, such as ½ to 2.5% or more, of an acid monomer in the monomer mixture used for making the copolymers of all three general types mentioned above by emulsion polymerization. Acids used include acrylic, methacrylic, itaconic, aconitic, citraconic, crotonic, maleic, fumaric, the dimer of methacrylic acid, etc. The aqueous dispersions are made using one or more emulsifiers of anionic, cationic, or nonionic or mixtures of two or more such emulsifiers may be used except that it is generally undesirable to mix a cationic with an anionic type emulsifier in any appreciable amount since they tend to neutralize each other. Those and other guidelines for preparation of aqueous emulsion-type coatings are well known to those of ordinary skill in the art and can be applied to the water thinned coatings finding expanded use in wood finishing operations in accordance with the present invention.

The following non-limiting examples are provided to further illustrate aqueous formulations of tannin sequestering agents useful in accordance with the present invention.

EXAMPLE 1

| SEALER FORMULATION | |
|---|---|
| INGREDIENT | LBS. |
| Water | 57 |
| Acrylic Emulsion | 35 |
| Butoxyethoxy Ethanol | 2 |
| Dipropylene Glycol | 2 |
| Versamine ® A-50 | 4 |
| Sandofix ® TP | 3 |

The sealer formulation can be used as a pre-coat for final sanding prior to application of, for example, an acrylic enamel to prevent staining of the applied water-based enamel coating by tannin-leaching from a wood surface. Alternatively, the sealer formulation is applied to a stained wood surface prior to a light sanding step, followed by application of a color coat, and a subsequently applied water-based water-white emulsion finish coats.

EXAMPLE 2

Non-Resinous Reactant Solution

A tannin-sequestering solution was prepared by dissolving 7.5 lbs. of sodium acetate and 4.6 lbs. of Versamine® A-50 in 87.9 lbs. of water. The solution is applied to a stained or unstained wood surface to prevent leaching of natural tannins and applied stains into after-applied water thinned emulsion coatings.

EXAMPLE 3

A wood surface treatment solution was prepared by dissolving 20 lbs. of Versamine® A-50 in 80 lbs. of water. The solution was effective when applied to wood surfaces to prevent tannin leachate discoloration of after-applied water-based emulsion coatings.

EXAMPLE 4

Primer Paint

An emulsion based primer paint is prepared by blending the following ingredients:

| INGREDIENT | LBS. |
|---|---|
| Water | 278 |
| Acrylic Resin | 281 |
| $TiO_2$ Pigment | 83 |
| Yellow Iron Oxide | 3 |
| Calcium Carbonate | 102 |
| Aluminum Silicate | 66 |
| Magnesium Silicate | 225 |
| Melamine Resin | 29 |
| Dimethylethanol amine | 0.12 |
| Versamine ® A-50 | 15 |
| Sodium Acetate | 35 |

The primer paint is applied to wood surfaces preliminary to application of a commercially available water-based latex paint. The primer paint prevents leaching of naturally occurring water soluble tannins in the wood surface into the after-applied latex coating.

We claim:

1. An environmentally sound water-based wood finishing process for obtaining a high quality finish on a wood surface by eliminating leaching of chromophoric compounds from said surface into applied water-based coatings said process comprising the steps of applying to the wood surface an effective amount of a composition comprising a water soluble alkali metal salt of a carboxylic acid and a water soluble organic compound bearing one or more salt-forming amine groups and having a molecular weight of about 50 to about 300,000; and thereafter applying to the wood surface a water-based wood finishing composition.

2. The method of claim 1 wherein the water soluble organic amine compound is selected from the group consisting of a monofunctional or polyfunctional amine, a reaction product of a monofunctional or polyfunctional amine with one or more compounds comprising an amine-reactive functional group, said reaction product having at least one salt-forming primary, secondary, or tertiary amine group, and acid addition salts of said monofunctional or polyfunctional amine and its said reaction products.

3. The method of claim 1 wherein the water soluble organic compound is a textile dye fixative.

4. The method of claim 1 wherein the water soluble compounds are applied to the wood surface in aqueous solution.

5. The method of claim 1 wherein the water soluble organic compound is a polyfunctional aliphatic amine curing agent for epoxy resins.

6. The method of claim 1 wherein the water soluble carboxylic acid salt is sodium acetate.

7. The method of claim 1 further comprising the step of applying a stain to the wood surface.

8. The method of claim 7 wherein the water-based wood finishing composition is an acrylic emulsion.

9. The method of claim 1 wherein the water soluble organic compound is a polyfunctional amine selected from the group consisting of ethylene diamine, diethylene triamine, triethylene tetraamine, and reaction products of said polyfunctional amines with one or more compounds comprising an amine-reactive functional group.

10. The method of claim 9 wherein the compound comprising an amine-reactive functional group is selected from the group consisting of ethylene oxide, propylene oxide, chloromethyloxirane, cyanamide, dicyanamide, guanidine, bisguanidine, formaldehyde, acetaldehyde, a dicarboxylic acid, a dicarboxylic acid monoester, a dicarboxylic acid diester, epichlorohydrin, and an N-methylol derivative of urea, melamine, guanamine, and a carbamate.

11. In a wood finishing process comprising application of a stain to the surface of a wood substrate and subsequent application of at least one water-based coating composition, the improvement comprising the step of contacting the stained wood surface with a water soluble compound selected from the group consisting of an alkali metal salt of a carboxylic acid and a water soluble organic compound bearing one or more salt-forming amine groups and having a molecular weight of about 50 to about 300,000, said compound being contacted with said surface in an amount effective to prevent leaching of the stain and other chromophoric compounds from the wood surface into the after-applied water-based coating.

12. The improvement of claim 11 wherein the water soluble organic amine is a monofunctional or polyfunctional amine, a reaction product of a monofunctional or polyfunctional amine with one or more compounds comprising an amine-reactive functional group, or an acid addition salt of said monofunctional or polyfunctional amine or its said reaction products.

13. The improvement of claim 11 wherein the water soluble compound is a polyfunctional amine curing agent for epoxy resins.

14. The improvement of claim 11 wherein the water soluble compound is a textile dye fixative.

15. The improvement of claim 11 wherein the water soluble compound is applied to the surface of the wood substrate in aqueous solution.

16. A method for reducing volatile organic compounds released in a wood finishing process including the steps of applying a stain and at least one after-applied solvent-based coating to a wood surface, without sacrificing wood finish quality, said method comprising the steps of, 1) contacting the wood surface with a water soluble compound selected from the group consisting of an alkali metal salt of a carboxylic acid and a water soluble organic compound bearing one or more salt-forming amine groups and having a molecular weight of about 50 to about 300,000, said compound being contacted with said surface in an amount effective to prevent leaching of chromophoric compounds from the surface into after-applied water-based coatings; and 2) substituting a water-based coating for the after-applied solvent-based coating.

17. The method of claim 16 wherein the water soluble amine compound is a monofunctional or polyfunctional amine, a reaction product of a monofunctional or polyfunctional amine with one or more compounds comprising an amine-reactive functional group, said reaction product having at least one salt-forming primary, secondary, or tertiary amine group, and acid addition salts of said monofunctional or polyfunctional amine and its said reaction products.

18. The method of claim 16 wherein the water soluble compound is a textile dye fixative.

19. The method of claim 16 wherein the water soluble compound is a polyfunctional amine curing agent for epoxy resins.

20. The method of claim 16 wherein the water soluble compound is contacted with the wood surface in aqueous solution.

21. The method of claim 16 wherein the step of contacting the wood surface with the water soluble compound is carried out before the step of applying a stain.

22. The method of claim 16 wherein the step of contacting the wood surface with the water soluble compound is carried out after application of a stain and before application of the substitute water-based coating.

23. The method of claim 22 wherein the water-based coating substituted for the after-applied oil-based coating is an acrylic emulsion.

24. The method of claim 16 wherein the wood surface is contacted with said water soluble compound in aqueous solution, said water soluble compound comprising an alkali metal salt of a carboxylic acid and a compound selected from the group consisting of monofunctional or polyfunctional amines and their reaction products with compounds comprising an amine-reactive function group.

25. The method of claim 24 wherein said water soluble compound comprises an aqueous solution of sodium acetate and a textile dye fixative or a polyfunctional amine curing agent for epoxy resins.

26. A method for preventing discoloration of water-based coatings applied to wood surfaces or metal-containing wood surfaces due to leaching of chromophoric compounds from the surface into said coatings said method comprising the step of applying to said surface a compound selected from the group consisting of an alkali metal salt of a carboxylic acid, a monofunctional amine or a polyfunctional amine selected from the group consisting of ethylene diamine, diethylene triamine and triethylene tetraamine, a reaction product of said monofunctional or polyfunctional amine with one or more compounds comprising an amine-reactive functional group, said reaction product having at least one salt-forming primary, secondary or tertiary amine group, and acid addition salts of said monofunctional or polyfunctional amine or its said reaction products.

27. The method of claim 26 wherein the compound is applied to the surface in an aqueous solution.

28. The method of claim 27 wherein the compound comprises a textile dye fixative or a polyfunctional amine curing agent for epoxy resins.

29. The method of claim 27 wherein the compound comprises a sodium or potassium salt of a carboxylic acid.

30. The method of claim 27 wherein said compound comprises sodium acetate in combination with a polyfunctional amine selected from the group consisting of polyfunctional amine textile dye fixatives and polyfunctional amine epoxy resin curing agents.

31. The method of claim 27 further comprising the step of forming an acrylic emulsion of the aqueous solution for application to the surface.

* * * * *